US010904960B2

(12) United States Patent
Kim et al.

(10) Patent No.: US 10,904,960 B2
(45) Date of Patent: Jan. 26, 2021

(54) COOKING APPLIANCE

(71) Applicant: SAMSUNG ELECTRONICS CO., LTD., Suwon-si (KR)

(72) Inventors: Tae-Hun Kim, Seongnam-si (KR); Jong-Hoon Lee, Suwon-si (KR); Woo Joo Kim, Suwon-si (KR); In Ki Jeon, Hwaseong-si (KR); Seong Joo Cho, Suwon-si (KR); Kun-Woo Choi, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 316 days.

(21) Appl. No.: 15/860,230

(22) Filed: Jan. 2, 2018

(65) Prior Publication Data

US 2018/0192482 A1 Jul. 5, 2018

(30) Foreign Application Priority Data

Jan. 3, 2017 (KR) ..... 10-2017-0000567

(51) Int. Cl.
*H05B 6/64* (2006.01)
*F24C 15/00* (2006.01)
*F24C 15/20* (2006.01)

(52) U.S. Cl.
CPC ..... *H05B 6/6444* (2013.01); *F24C 15/006* (2013.01); *F24C 15/008* (2013.01); *F24C 15/2007* (2013.01)

(58) Field of Classification Search
CPC .. H05B 6/6444; F24C 15/2007; F24C 15/006; F24C 15/008
USPC ..... 219/758; 165/185; 126/299 D; 362/294, 362/249.02, 373
See application file for complete search history.

(56) References Cited

U.S. PATENT DOCUMENTS 2,875,316 A * 2/1959 Ford ..... F24H 3/0411 219/473
3,701,895 A * 10/1972 Sweetser ..... F21S 8/02 362/264
5,382,939 A 1/1995 Hong
6,093,918 A 7/2000 Sohn
(Continued)

FOREIGN PATENT DOCUMENTS

DE 20 2015 104549 10/2015
EP 2 251 588 11/2010
(Continued)

OTHER PUBLICATIONS

International Search Report dated Apr. 23, 2018 from International Patent Application No. PCT/KR2018/000036, 3 pages.
(Continued)

*Primary Examiner* — Lien M Ngo
(74) *Attorney, Agent, or Firm* — Staas & Halsey LLP

(57) ABSTRACT

Disclosed herein are a lamp module that includes a double insulation structure and a cooling structure, thus being usable even in a high temperature condition, and a cooking appliance including the same. The cooking appliance includes a cooking compartment, a cooling fan disposed at an upper portion of the cooking compartment to suction outside air, and a lamp module configured to illuminate an inside of the cooking compartment and disposed adjacent to the cooling fan to exchange heat with the outside air suctioned by the cooling fan.

18 Claims, 8 Drawing Sheets

(56) References Cited

U.S. PATENT DOCUMENTS

| | | | | |
|---|---|---|---|---|
| 7,950,826 | B2 * | 5/2011 | Shin | F21K 9/233 362/249.02 |
| 8,997,732 | B2 * | 4/2015 | Oagley | F24C 15/2064 126/213 |
| 9,482,436 | B1 * | 11/2016 | Hettinger | F24C 15/008 |
| 9,513,015 | B2 * | 12/2016 | Estrella | F24C 15/006 |
| 9,885,469 | B2 * | 2/2018 | Baumeister | F21V 29/503 |
| 10,480,769 | B2 * | 11/2019 | Luo | F21V 29/15 |
| 2011/0149551 | A1 | 6/2011 | Camarillo Fernandez et al. | |
| 2011/0170287 | A1 * | 7/2011 | Medinis | F21K 9/00 362/235 |
| 2012/0152226 | A1 * | 6/2012 | Oagley | F24C 15/20 126/299 D |
| 2012/0152227 | A1 * | 6/2012 | Oagley | F24C 15/2064 126/299 D |
| 2014/0061188 | A1 | 3/2014 | Liu et al. | |

FOREIGN PATENT DOCUMENTS

| | | | |
|---|---|---|---|
| EP | 2 333 425 | A1 | 6/2011 |
| EP | 2 868 980 | | 5/2015 |
| GB | 2 462 172 | A | 2/2010 |
| JP | 2012-251738 | | 12/2012 |
| JP | 2014-123425 | | 7/2014 |
| KR | 20-0232526 | | 9/2001 |
| KR | 10-2006-0063148 | | 6/2006 |
| KR | 10-2007-0114548 | | 12/2007 |
| KR | 10-2015-0137756 | | 12/2015 |
| WO | 2014/008265 | | 1/2014 |
| WO | WO 2018/001796 | A1 * | 1/2018 |

OTHER PUBLICATIONS

Extended European Search Report dated Dec. 3, 2019 in corresponding European Patent Application No. 18735887.4.

* cited by examiner

COOKING APPLIANCE

CROSS-REFERENCE TO RELATED APPLICATION

This application claims the benefit of Korean Patent Application No. 10-2017-0000567, filed on Jan. 3, 2017 in the Korean Intellectual Property Office, the disclosure of which is incorporated herein by reference.

BACKGROUND

1. Field

Embodiments of the present disclosure relate to a cooking appliance, and more particularly, to a cooking appliance including a light emitting diode (LED) lamp.

2. Description of the Related Art

Generally, a cooking appliance is an apparatus including a cooking compartment, a heater configured to apply heat to the cooking compartment, and a circulation fan configured to circulate heat generated by the heater inside the cooking compartment and configured to cook food.

A cooking appliance is an apparatus configured to seal and heat a cooking compartment to cook food and is generally classified as an electric type, a gas type, and an electronic type depending on a heat source thereof. An electric cooking appliance uses an electric heater as a heat source, and a gas cooking appliance and an electronic cooking appliance respectively use heat generated by gas and frictional heat of water molecules due to high frequency waves as heat sources.

A state of an object to be cooked inside a cooking compartment needs to be checked during a cooking process using a cooking appliance. For this, a lamp is installed in the cooking compartment or in a door configured to open and close the cooking compartment.

Nowadays, the number of home appliances using a light emitting diode (LED) having great advantages in terms of power consumption and service life in comparison to a conventional halogen lamp or a light bulb is rapidly increasing. Following such a trend, there have been attempts to use an LED also in a cooking appliance.

However, because an LED operates at a temperature condition lower than those of a halogen lamp and a light bulb, there has been a difficulty in satisfying such a temperature condition.

Also, a hole should be provided for light of a lamp to pass therethrough to illuminate an inside of a cooking compartment. However, in the case of an electronic cooking appliance using high frequency waves, when a size of a hole is too large, the high frequency waves may exit through the hole, and an object to be cooked may not be effectively heated. Consequently, a plurality of holes having a small size so that light of a lamp passes therethrough while high frequency waves cannot exit therethrough may be provided in a cooking compartment.

However, due to a characteristic of an LED, light radiated from an LED has high linearity. Because of this, a shadow may be formed due to the plurality of holes provided in the cooking compartment. Such a shadow may degrade emotional quality of a product.

SUMMARY

Therefore, it is an aspect of the present disclosure to provide a lamp module including a light emitting diode (LED) lamp and a cooking appliance including the same.

It is another aspect of the present disclosure to provide a lamp module that satisfies a temperature condition for an LED to operate and a cooking appliance including the same.

It is still another aspect of the present disclosure to provide a lamp module, which uses an LED but does not cause a shadow to be formed inside a cooking compartment, and a cooking appliance including the same.

Additional aspects of the disclosure will be set forth in part in the description which follows and, in part, will be obvious from the description, or may be learned by practice of the disclosure.

In accordance with one aspect of the present disclosure, a cooking appliance includes a cooking compartment, a cooling fan disposed at an upper portion of the cooking compartment to suction outside air, and a lamp module configured to illuminate an inside of the cooking compartment and disposed adjacent to the cooling fan to exchange heat with the outside air suctioned by the cooling fan.

The lamp module may include an LED lamp configured to radiate light toward the cooking compartment.

The lamp module may further include a plurality of glasses configured to insulate the LED lamp from hot air inside the cooking compartment in multiple layers.

The plurality of glasses may include a first glass and a second glass that are placed above and below each other, and the first glass may include an etching glass configured to disperse light radiated from the LED lamp.

The lamp module may further include a case having one open surface and configured to accommodate the LED lamp, and the second glass may be disposed to cover the open surface of the case.

The lamp module may further include a sealing member coupled to the second glass to couple the second glass to the case and seal a space between the open surface of the case and the second glass.

The case may include an air suction hole configured to suction outside air and an air exhaust hole configured to discharge the outside air suctioned through the air suction hole.

The air suction hole may be disposed at both side surfaces of the case, and the air exhaust hole may be disposed at a rear surface of the case.

The LED lamp may be disposed in front of the case to prevent light radiated from the LED lamp from exiting through the air exhaust hole.

The case may further include a bracket unit disposed for the case to be coupled to an upper surface of the cooking compartment.

The cooling fan may include a suction hole disposed at both side surfaces of the cooling fan to suction outside air and a discharge hole disposed at a rear surface of the cooling fan to discharge the outside air suctioned through the suction hole.

The lamp module may be disposed in front of the cooling fan for outside air to be suctioned into the cooling fan to pass through the lamp module and then be suctioned into the cooling fan.

The cooking appliance may further include a heater disposed at the upper surface of the cooking compartment to heat an object to be cooked inside the cooking compartment.

The lamp module may be placed above and in front of the heater to reduce hot air being transferred to the lamp module.

The cooking compartment may include a first cooking compartment and a second cooking compartment that are placed above and below each other.

In accordance with another aspect of the present disclosure, a cooking appliance includes a cooking compartment, a heater disposed inside the cooking compartment to heat an object to be cooked, and a lamp module including an LED lamp configured to illuminate an inside of the cooking compartment and a plurality of glasses configured to insulate the LED lamp from hot air inside the cooking compartment in multiple layers.

The plurality of glasses may include a first glass and a second glass that are placed above and below each other, and the first glass may include an etching glass configured to disperse light radiated from the LED lamp.

The lamp module may further include a case configured to accommodate the LED lamp, and the case may include an air suction hole disposed at both side surfaces of the case and configured to suction outside air and an air exhaust hole disposed at a rear surface of the case and configured to discharge the outside air suctioned through the air suction hole.

The LED lamp may be disposed in front of the case to prevent light radiated from the LED lamp from exiting through the air exhaust hole.

In accordance with still another aspect of the present disclosure, a lamp module includes a case having one open surface, an LED lamp coupled to the case to radiate light toward the open surface of the case, and a plurality of glasses configured to cover the open surface and insulate the LED lamp from hot air from outside the case in multiple layers.

In accordance with still another aspect of the present disclosure, a cooking appliance includes a cooking compartment; a cooling fan disposed at an upper portion of the cooking compartment to suction air into the cooking appliance and discharge the suctioned air out of the cooking appliance to thereby form an air flow path; and a lamp assembly configured to illuminate an inside of the cooking compartment, and the lamp assembly being disposed on the air flow path so that the lamp assembly exchanges heat with the suctioned air.

The lamp assembly may include a light emitting diode (LED) lamp configured to radiate light toward the cooking compartment.

The lamp assembly may further include a plurality of glasses configured to insulate the LED lamp in multiple layers from hot air inside the cooking compartment.

The plurality of glasses may include a first glass and a second glass that are placed above and below each other, respectively, and the first glass may include an etching glass configured to disperse light radiated from the LED lamp.

The lamp assembly may further include a case having an open surface and, the case is configured to accommodate the LED lamp, and the second glass is disposed to cover the open surface of the case.

The lamp assembly may further include a sealing member couplable to the second glass and the case to thereby couple the second glass to the case and seal a space between the open surface of the case and the second glass.

The case may include an air suction hole configured to suction the air into the case; and an air exhaust hole configured to discharge the suctioned air suctioned through the air suction hole. The air suction hole may be disposed at both side surfaces of the case; and the air exhaust hole may be disposed at a rear surface of the case.

The LED lamp may be disposed at a front of the case to prevent light radiated from the LED lamp from exiting through the air exhaust hole.

The case may further include at least one bracket so that the case is couplable to an upper surface of the cooking compartment.

The cooling fan may include a suction hole disposed at both side surfaces of the cooling fan to suction the air; and a discharge hole disposed at a rear surface of the cooling fan to discharge the suctioned air.

The lamp assembly may be disposed in front of the cooling fan for the air to be suctioned into the cooling fan to pass through the lamp assembly and then be suctioned into the cooling fan.

The cooking appliance may further include a heater disposed at an upper surface of the cooking compartment to heat an object to be cooked inside the cooking compartment.

The lamp assembly may be placed above and in front of the heater to reduce hot air being transferred to the lamp assembly.

The cooking compartment may include a first cooking compartment and a second cooking compartment that are placed above and below each other, respectively.

In accordance with still another aspect of the present disclosure, a cooking appliance may include a cooking compartment a heater disposed inside the cooking compartment to heat an object to be cooked; and a lamp assembly including a light emitting diode (LED) lamp configured to illuminate an inside of the cooking compartment, and a plurality of glasses configured to insulate the LED lamp in multiple layers from hot air inside the cooking compartment.

The plurality of glasses may include a first glass and a second glass that are placed above and below each other, respectively; and the first glass may include an etching glass configured to disperse light radiated from the LED lamp.

The lamp assembly may further include a case configured to accommodate the LED lamp; and the case may include an air suction hole disposed at both side surfaces of the case and configured to suction air into the case, and an air exhaust hole disposed at a rear surface of the case and configured to discharge the suctioned air suctioned through the air suction hole.

The LED lamp may be disposed at a front of the case to prevent light radiated from the LED lamp from exiting through the air exhaust hole.

In accordance with still another aspect of the present disclosure, a lamp assembly may include a case having an open surface; a light emitting diode (LED) lamp coupled to the case to radiate light toward the open surface of the case; and a plurality of glasses configured to cover the open surface and insulate the LED lamp in multiple layers from hot air from outside the case.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, exemplary embodiments according to the present disclosure will be described in detail with reference to the accompanying drawings.

Figure 1:
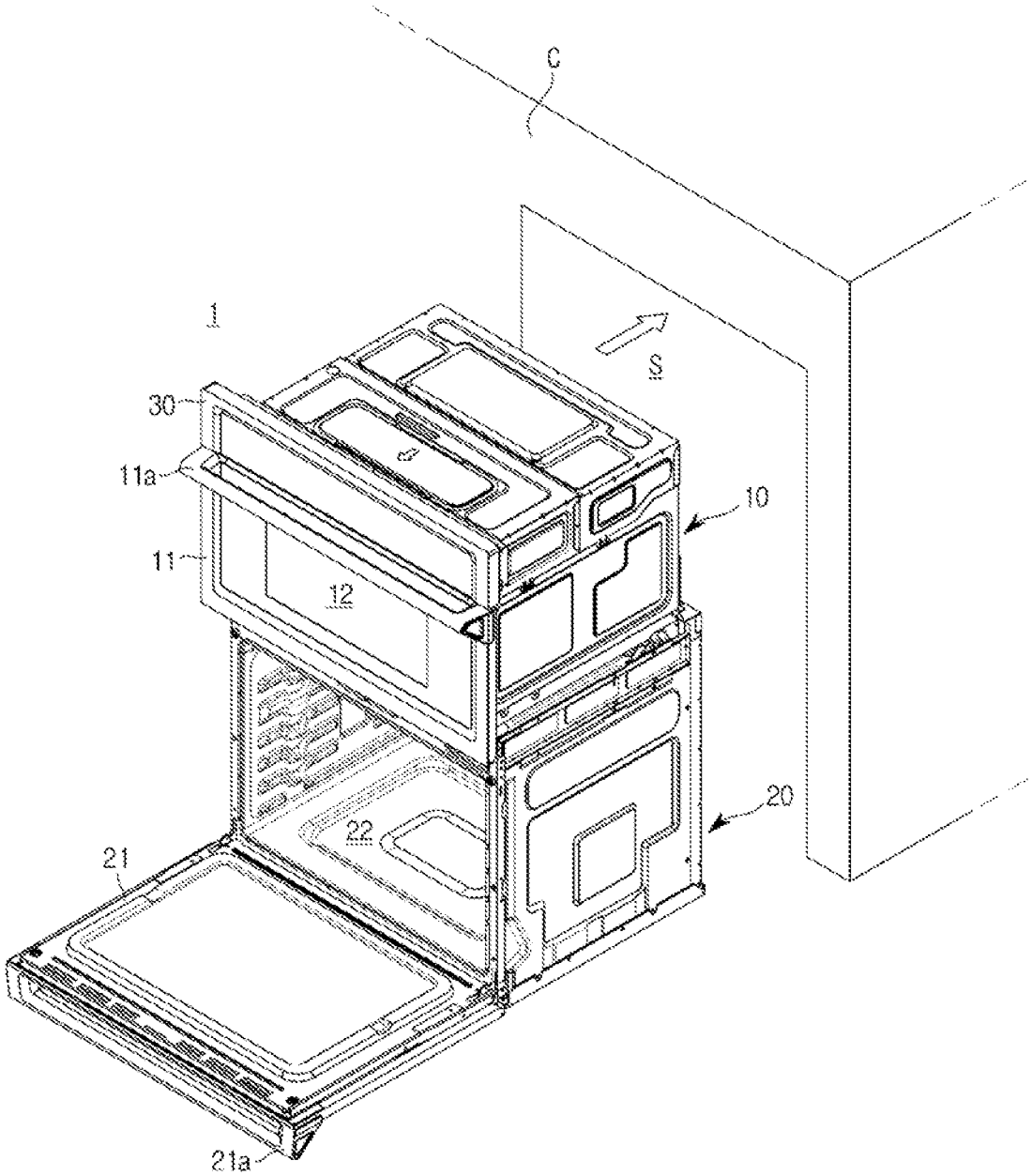
FIG. 1 is a perspective view illustrating a cooking appliance according to one embodiment of the present disclosure.
Figure 2:
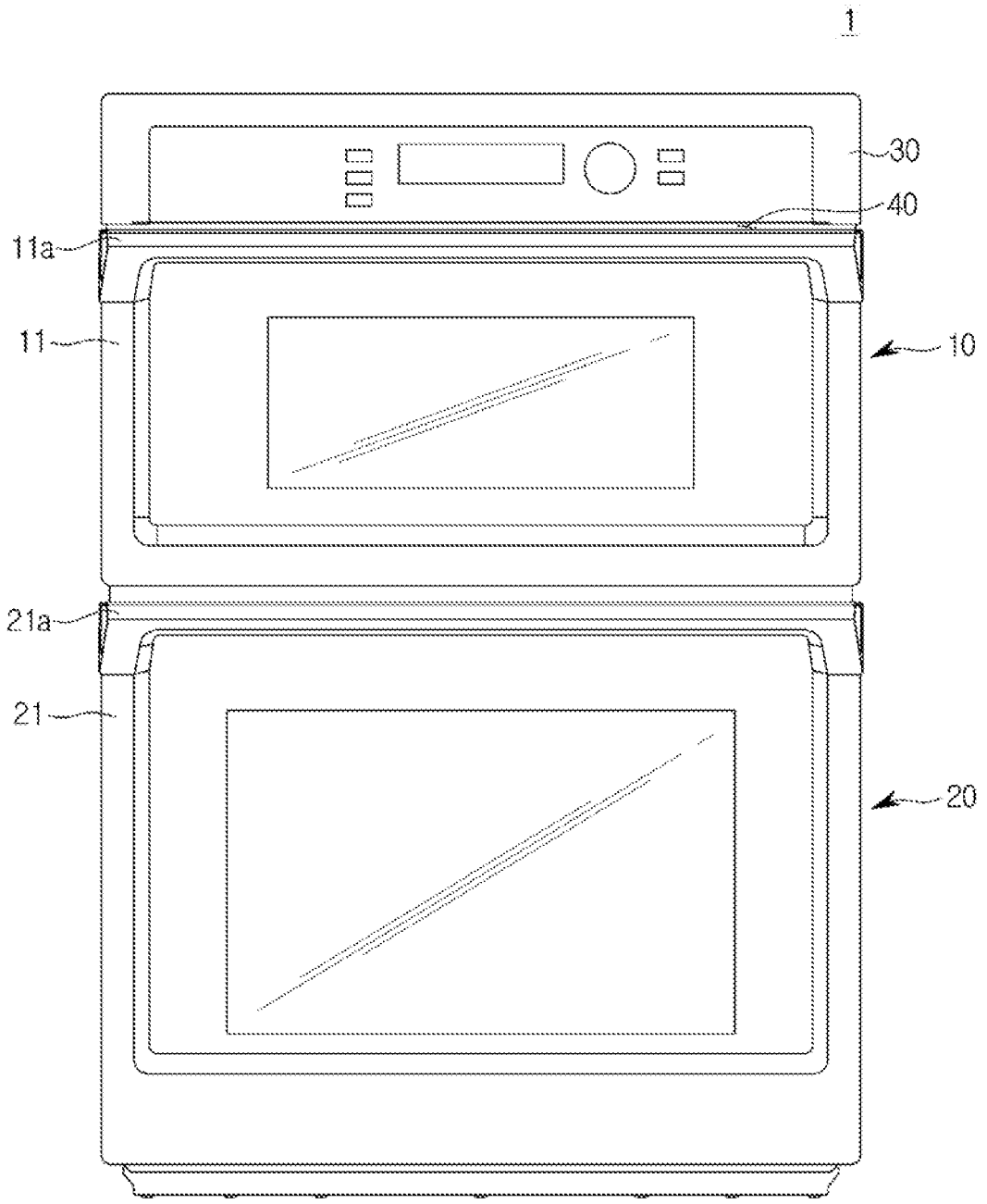
FIG. 2 is a front view illustrating the cooking appliance according to one embodiment of the present disclosure.

FIG. 1 is a perspective view illustrating a cooking appliance according to one embodiment of the present disclosure, and FIG. 2 is a front view illustrating the cooking appliance according to one embodiment of the present disclosure.

Figure 3:
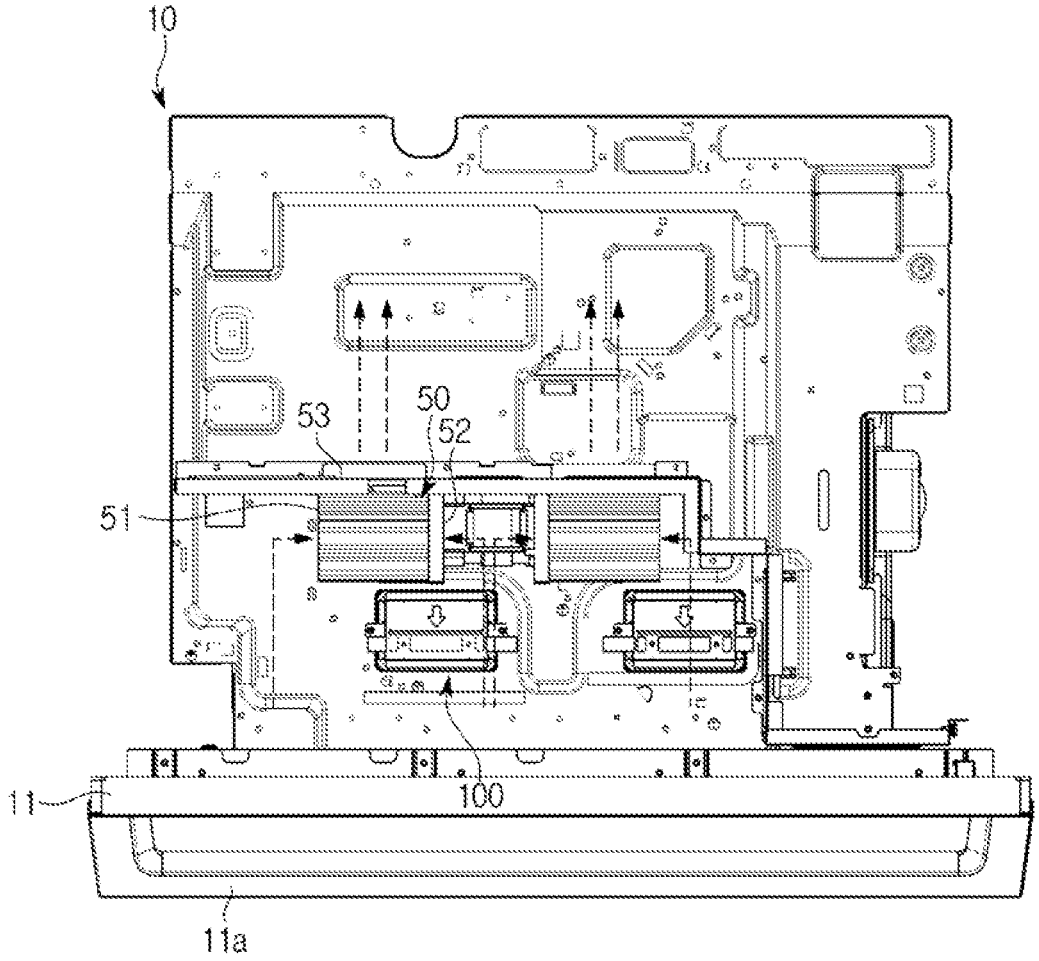
FIG. 3 is a view illustrating dispositions of a cooling fan and a lamp module in the cooking appliance according to one embodiment of the present disclosure.
Figure 4:
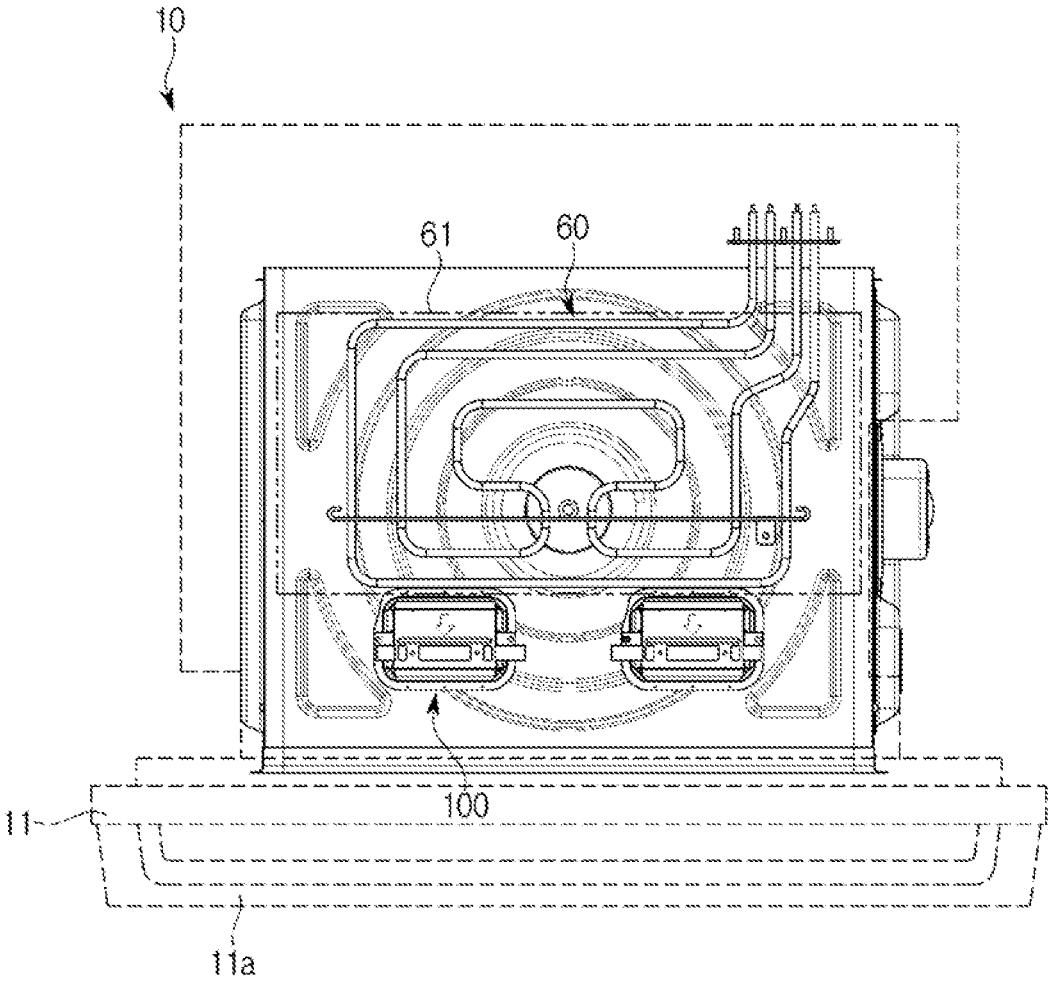
FIG. 4 is a view illustrating dispositions of a heater and the lamp module in the cooking appliance according to one embodiment of the present disclosure.
Figure 5:
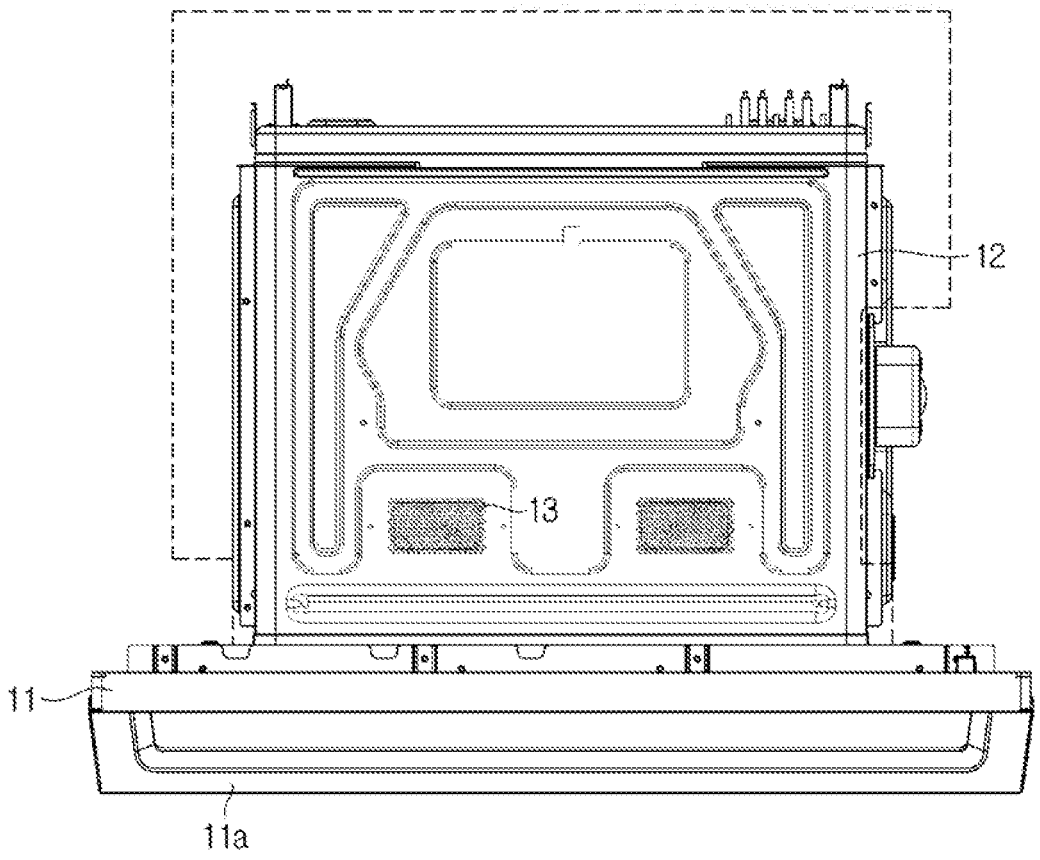
FIG. 5 is a view illustrating an upper surface of the cooking compartment at which a lamp mounting portion including a plurality of holes is disposed in the cooking appliance according to one embodiment of the present disclosure.

FIG. 3 is a view illustrating dispositions of a cooling fan and a lamp module in the cooking appliance according to one embodiment of the present disclosure, FIG. 4 is a view illustrating dispositions of a heater and the lamp module in the cooking appliance according to one embodiment of the present disclosure, and FIG. 5 is a view illustrating an upper surface of the cooking compartment at which a lamp mounting portion including a plurality of holes is disposed in the cooking appliance according to one embodiment of the present disclosure.

As illustrated in FIGS. 1 and 2, a cooking appliance 1 may be installed inside a wall or a cabinet C to have a sense of integration with a kitchen space.

For example, the cabinet C for the cooking appliance 1 to be installed therein may have an open front surface, and the cooking appliance 1 may be accommodated in an inner seating portion S of the cabinet C through the open portion.

The cooking appliance 1 may include a first cavity 10 and a second cavity 20 provided for cooking food and a control panel 30 in which various electric components are installed.

The first cavity 10 and the second cavity 20 may be vertically stacked and disposed. Although a case in which the first cavity 10 is disposed at an upper portion of the second cavity 20 is illustrated as an example in the embodiment of the present disclosure, dispositions of the first cavity 10 and the second cavity 20 are not limited thereto.

The first cavity 10 may include a first cooking compartment 12, and the second cavity 20 may include a second cooking compartment 22.

A heater 60 (see FIG. 4) may be disposed at an upper portion of the first cooking compartment 12. The heater 60 may be configured to heat an inside of the first cooking compartment 12 using radiant heat. The heater 60 may be an electric heater using electricity.

A convection device (not illustrated) may be disposed in the second cavity 20. The convection device is disposed to heat and circulate air inside the cooking compartment to cook food inside the cooking compartment separate from the heater. Preferably, at least one or more convection devices are installed at a rear surface of the second cavity 20. The convection device may be installed in the first cavity as well as the second cavity.

Each of the first cavity 10 and the second cavity 20 may be formed in a rectangular parallelepiped shape having an open front surface. The first cavity 10 and the second cavity 20 may respectively include doors 11 and 21 configured to selectively open and close the open front surfaces thereof. The doors 11 and 21 may include a first door 11 configured to open and close the first cavity 10 and a second door 21 configured to open and close the second cavity 20. The doors 11 and 21 may respectively include handles 11*a* and 21*a* for a user to grasp the handles 11*a* and 21*a* and easily open and close the doors 11 and 21.

The control panel 30 may be placed above and in front of the first cavity 10 to receive an operation signal for operations of the first cavity 10 and the second cavity 20. The control panel 30 may be configured to display information related to the operations of the first cavity 10 and the second cavity 20. An electronic component room (not illustrated) for a plurality of electronic components to be installed therein may be disposed behind the control panel 30.

A suction hole 41 configured to suction outside air may be formed between the control panel 30 and the first cavity 10. The suction hole 41 may be formed at a front portion between the control panel 30 and the first cavity 10.

Although not illustrated, a magnetron configured to supply high frequency waves to an inside of the first cavity 10 or the second cavity 20, and a high-pressure transformer, a high-pressure condenser, a high-pressure diode, and the like constituting a driver circuit configured to drive the magnetron may be installed inside the electronic component room (not illustrated) of the cavities 10 and 20 at which the control panel 30 is installed. According to the present embodiment, although the above-mentioned elements for supplying high frequency waves are configured to provide high frequency waves to the inside of the first cooking compartment 12, embodiments are not limited thereto, and the elements may also supply high frequency waves to an inside of the second cooking compartment 22.

The electronic component room (not illustrated) may be disposed at an upper portion of the first cavity 10. At least one or more cooling fans 50 may be disposed in the electronic component room (not illustrated). As illustrated in FIG. 3, two cooling fans 50 disposed in parallel to each other may be disposed in the electronic component room.

The cooling fan 50 may suction outside air through a first suction hole 51 and a second suction hole 52 disposed at both side surfaces thereof. Here, the outside air suctioned through the suction holes 51 and 52 may cool various electronic components inside the electronic component room.

The cooling fan 50 may include a discharge hole 53 disposed at a rear surface thereof. When a cooling motor (not illustrated) of the cooling fan 50 is operated, outside air may be suctioned through the suction holes 51 and 52 as described above and then discharged through the discharge hole 53.

A lamp module 100 may be disposed on an air flow path formed by the cooling fan 50. In this way, the lamp module 100 may be cooled by outside air suctioned by the cooling fan 50.

As illustrated in FIG. 3, the lamp module 100 may be disposed in front of the cooling fan 50. More specifically, the lamp module 100 may be disposed adjacent to the second suction hole 52 to be cooled by outside air suctioned by the cooling fan 50. In this way, outside air passes through the lamp module 100 before being suctioned into the second suction hole 52, and the lamp module 100 is cooled by the outside air. Consequently, temperature of the lamp module 100 is decreased. As will be described below, the lamp module 100 includes an LED 111 as a light source thereof, and the LED 111 has advantages in terms of superior power consumption, service life, and illuminance in comparison to a halogen lamp. However, because the LED 111 is able to operate only in a lower temperature condition in comparison to a halogen lamp, there may be difficulty in applying the LED 111 to a space in a high temperature condition such as an upper portion of the cooking compartment. According to the idea of the present disclosure, the lamp module 100 including the LED 111 may be disposed adjacent to the cooling fan 50 and be effectively cooled by outside air. Accordingly, the temperature of the lamp module 100 may be lowered, and the lamp module 100 including the LED 111 may be installed even in a space in a high temperature condition such as the upper portion of the cooking compartment.

Although the lamp module 100 is disposed beside the second suction hole 52 in the present embodiment illustrated in FIG. 3, embodiments are not limited thereto. That is, the lamp module 100 may also be disposed in front of the first suction hole 51, in front of the second suction hole 52, and beside the first suction hole 51.

The lamp module 100 may also be disposed behind the cooling fan 50. Although an example in which the lamp module 100 is disposed in front of the cooling fan 50 is illustrated in FIG. 3, unlike this, the lamp module 100 may be disposed behind the discharge hole 53. In this way, the lamp module 100 may be cooled by outside air discharged from the discharge hole 53. Because outside air suctioned through the first suction hole 51 and outside air suctioned through the second suction hole 52 are combined and discharged through the discharge hole 53, the lamp module 100 may be more effectively cooled in comparison to a case in which the lamp module 100 is cooled by any one of the first suction hole 51 and the second suction hole 52. This is because, due to the amount of outside air discharged through the discharge hole 53 being larger than the amount of outside air suctioned into any one of the first suction hole 51 and the second suction hole 52, the amount of heat exchange between the lamp module 100 and outside air is increased.

As illustrated in FIG. 4, according to an embodiment of the present disclosure, the heater 60 may be disposed at an upper portion of the first cooking compartment 12. As described above, the heater 60 may transfer radiant heat and heat the inside of the first cooking compartment 12. The radiant heat radiated from the heater 60 may also be transferred to the lamp module 100 disposed adjacent to the heater 60 in addition to the first cooking compartment 12.

The lamp module 100 may include the LED 111 that is relatively vulnerable to high temperature, and the lamp module 100 may be disposed outside and above the first cooking compartment 12. The heater 60 may be disposed inside and above the first cooking compartment 12. That is, the lamp module 100 and the heater 60 may be placed above and below each other with an upper surface of the first cooking compartment 12 disposed therebetween.

The lamp module 100 may be disposed in front of an area 61 in which the heater 60 is disposed. In this way, the amount of radiant heat transferred to the lamp module 100 may be reduced in comparison to a case in which the lamp module 100 is disposed on the area 61 in which the heater 60 is disposed. In other words, the amount of radiant heat transferred to the lamp module 100 when the lamp module 100 is disposed on the area 61 heated by the heater 60 is extremely larger than the amount of radiant heat transferred to the lamp module 100 when the lamp module 100 is not disposed on the area 61 heated by the heater 60. Consequently, according to an embodiment of the present disclosure, as illustrated in FIG. 4, the lamp module 100 may not be disposed in the area 61 in which the heater is disposed. The lamp module 100 may be disposed in front of the area 61 in which the heater is disposed. By such a disposition, the lamp module 100 may be relatively prevented from being heated by the heater 60, and the maximum temperature of the lamp module 100 may be lowered. That is, a temperature condition at which the LED 111 is usable may be satisfied.

As illustrated in FIG. 5, a lamp mounting portion 13 may be disposed at the upper surface of the first cooking compartment 12. The lamp mounting portion 13 may include a plurality of holes having a small size. The plurality of holes having a small size are disposed to allow light radiated from the lamp module 100 to pass therethrough while preventing high frequency waves inside the first cooking compartment 12 from passing therethrough.

However, when light radiated from the LED 111 passes through the lamp mounting portion 13, because light radiated from the LED 111 has high linearity due to a characteristic of the LED 111, a shadow may be formed inside the first cooking compartment 12. That is, shadows corresponding to the plurality of holes disposed in the lamp mounting portion may be formed inside the first cooking compartment 12. When the shadow is formed in this way, the inside of the cooking compartment may not be evenly illuminated, and user convenience may be lowered. Also, emotional quality of the cooking appliance may be degraded.

Figure 6:
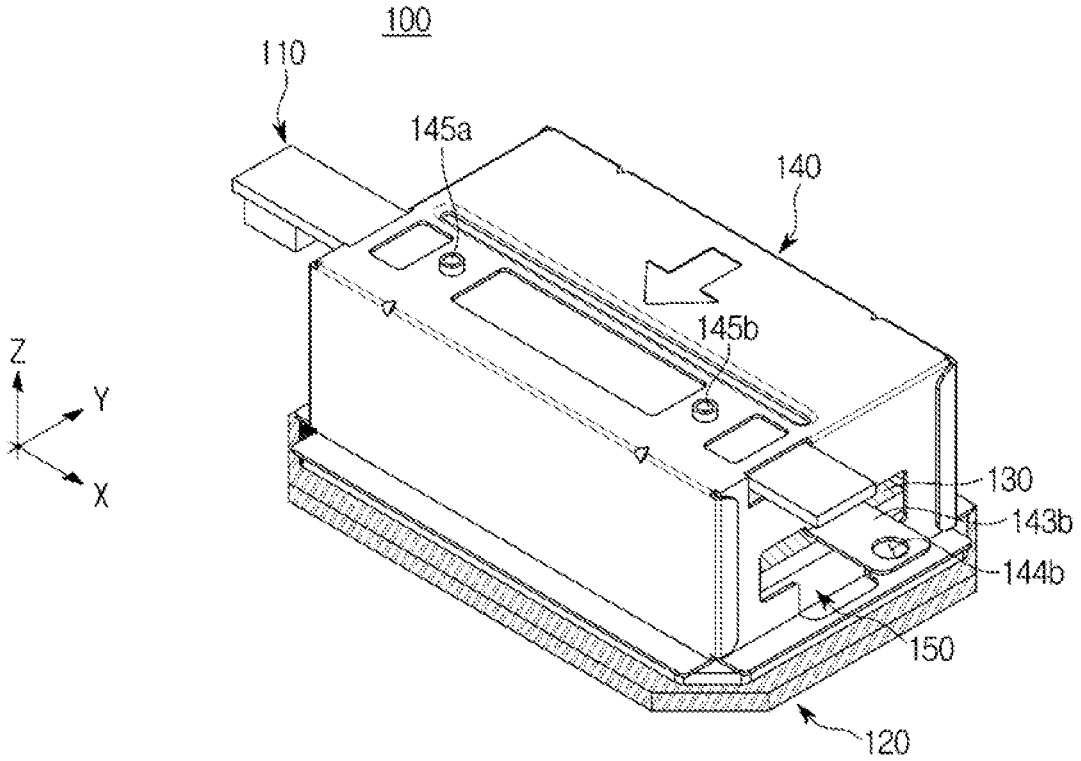
FIG. 6 is a view illustrating an exterior of the lamp module according to one embodiment of the present disclosure.

To solve this, the lamp module 100 according to the idea of the present disclosure may include an etching glass 120 (see FIG. 6). The etching glass 120 may be configured to disperse light radiated from the LED 111. The light radiated from the LED 111 may be dispersed through the etching glass 120, and in this way, a shadow may be prevented from being formed inside the first cooking compartment 12 even when the light passes through the lamp mounting portion 13. The disposition of the etching glass 120 will be described below.

Figure 7:
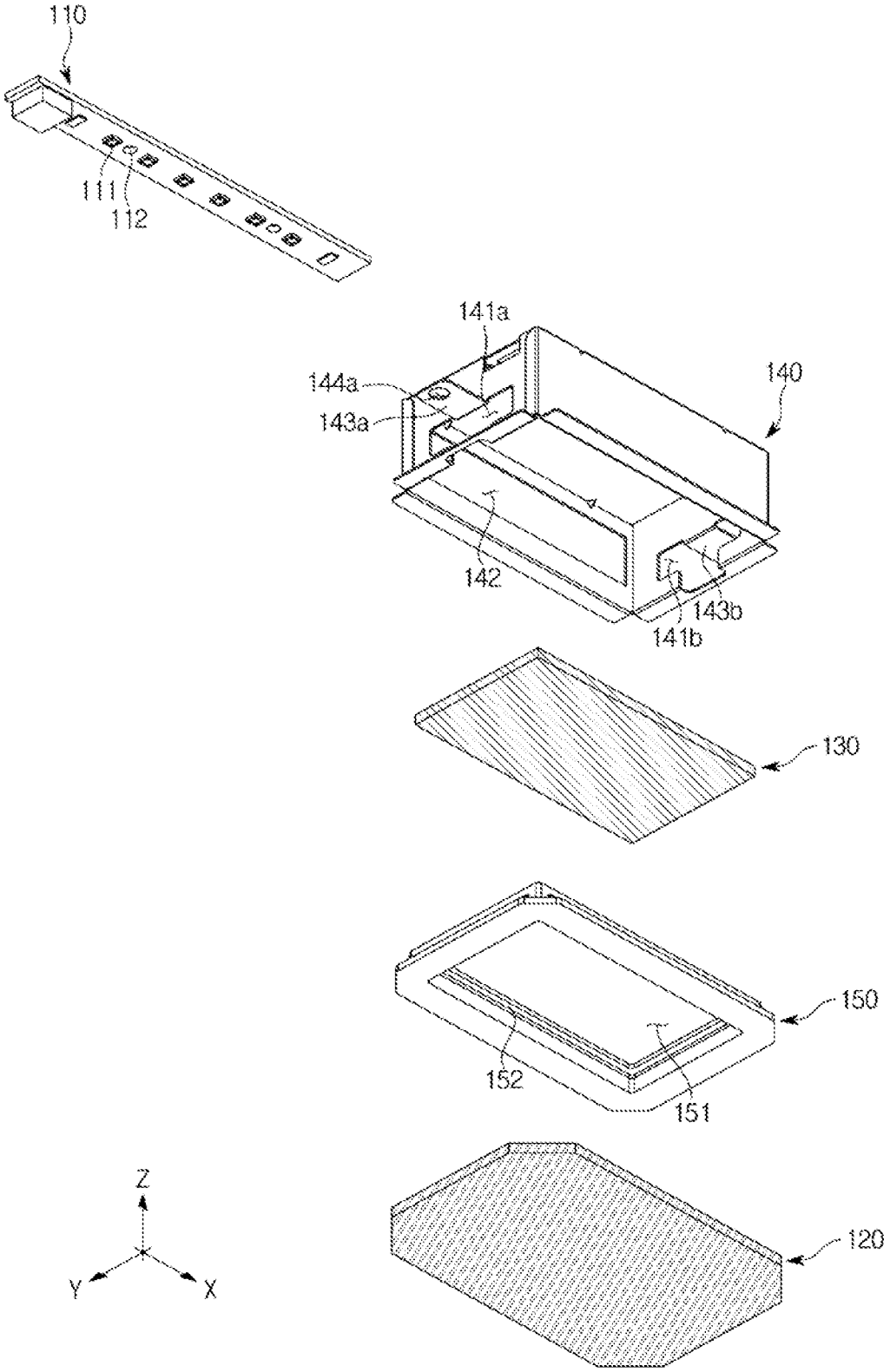
FIG. 7 is an exploded perspective view of the lamp module illustrated in FIG. 6.
Figure 8:
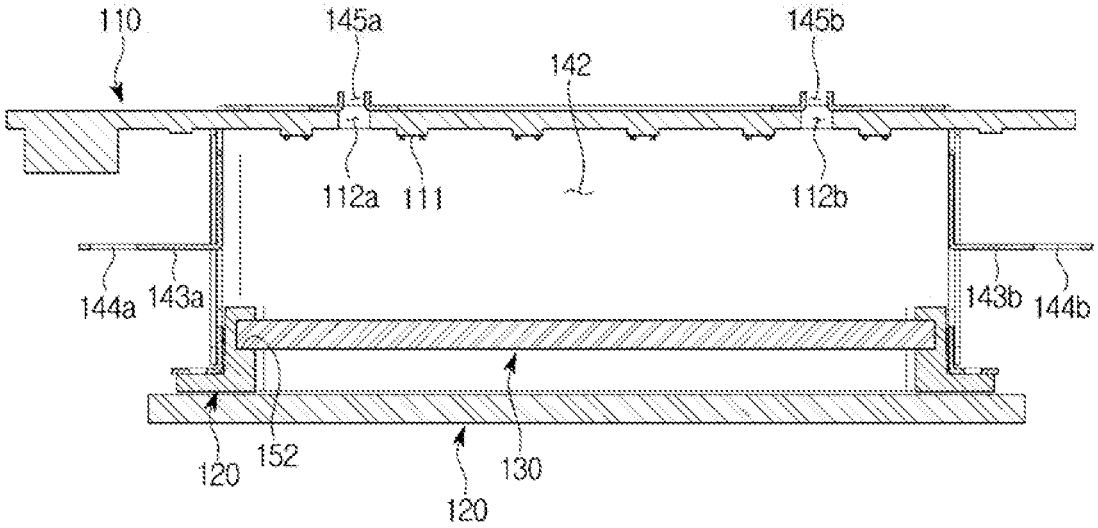
FIG. 8 is a side cross-sectional view of the lamp module illustrated in FIG. 6.

FIG. 6 is a view illustrating an exterior of the lamp module according to one embodiment of the present disclosure, FIG. 7 is an exploded perspective view of the lamp module illustrated in FIG. 6, and FIG. 8 is a side cross-sectional view of the lamp module illustrated in FIG. 6.

Hereinafter, the lamp module according to an embodiment of the present disclosure will be described in detail with reference to FIGS. 6 to 8.

The lamp module 100 may include a case 140, an LED lamp 110 including a plurality of LEDs 111, and a plurality of glasses configured to insulate the LED lamp 110 from hot air outside the case 140 in multiple layers.

The case 140 may be formed in a rectangular parallelepiped shape having one open surface. The case 140 may include an air suction hole 141 configured to suction outside air and an air exhaust hole 142 configured to discharge the outside air suctioned through the air suction hole 141.

The air suction hole 141 may be disposed at both side surfaces (141*a* and 141*b*) of the case 140, and the air exhaust hole 142 may be disposed at a rear surface of the case 140.

Because the case 140 does not include a separate configuration such as a motor configured to suction outside air, the air suction hole 141 and the air exhaust hole 142 may serve as a movement path of outside air suctioned by the cooling fan 50. Specifically, outside air to be suctioned by the cooling fan 50 may pass through the lamp module 100 disposed in front of the cooling fan 50 and then be suctioned into the cooling fan 50. Here, outside air may be introduced into the case 140 through the air suction hole 141 and be discharged to the outside of the case 140 through the air exhaust hole 142. The LED 111 disposed inside the case 140 may be efficiently cooled by such an air flow. By cooling the LED 111, a temperature condition for the LED 111 may be satisfied.

The LED lamp 110 may include a plurality of LEDs 111 spaced apart from each other. The LED lamp 110 may include an engaging hole 112 disposed to correspond to a coupling hole 145 of the case 140. According to the present embodiment, the LED lamp 110 may be formed in a stick shape and include six LEDs 111 disposed in a longitudinal direction of the LED lamp 110. A first engaging hole 112*a* and a second engaging hole 112*b* may be disposed between the LEDs 111. However, the shape of the LED lamp 110 and the number of LEDs 111 are not limited and may be changed depending on the design specifications.

As illustrated in FIG. 6, the LED lamp 110 may be disposed in front of the case 140. This is to prevent light radiated from the LED 111 from exiting through the air exhaust hole 142 disposed behind the case 140. That is, by decreasing the amount of light exiting through the air exhaust hole 142, the illuminance inside the first cooking compartment 12 may be increased.

The lamp module 100 may include the plurality of glasses configured to insulate the LED lamp 110 from hot air outside the case 140 in multiple layers.

The plurality of glasses may include a first glass 120 and a second glass 130. The first glass and the second glass, i.e., the two glasses, are merely an example, and the plurality of glasses may include three or more glasses.

The first glass 120 and the second glass 130 may be placed above and below each other. Hereinafter, a glass placed below the other glass will be referred to as the first glass, and the glass placed above the first glass will be referred to as a second glass.

The first glass 120 may be configured to disperse light emitted from the LED 111. As described above, because light emitted from the LED 111 has high linearity, such a characteristic may be mitigated by the light passing through the first glass 120. The first glass 120 may be an etching glass that is appropriate for dispersing light. The etching glass may refer to a glass that is etched using various methods.

The first glass 120 may be disposed at an upper portion of the lamp mounting portion 13. That is, the first glass 120 may be disposed at an upper portion of the plurality of holes formed in the lamp mounting portion 13 and cover the plurality of holes. In this way, light that passed through the first glass 120, which is an etching glass, may pass through the plurality of holes formed in the lamp mounting portion 13. Also, because light radiated from the LED 111 passes through the etching glass, a shadow is not formed inside the first cooking compartment 12 even when the light passes through the lamp mounting portion 13.

The second glass 130 may be disposed to cover the open surface of the case 140. The second glass 130 may be smaller than the open surface of the case 140. Consequently, the open surface of the case 140 may not be completely covered by the second glass 130.

The lamp module 100 may include a sealing member 150 coupled to the second glass 130 and configured to seal the open surface of the case 140.

The sealing member 150 may be coupled to the second glass 130. The sealing member 150 may include an opening 151, a rib protruding upward from the opening 151, and a glass insertion groove 152 formed at the rib.

An edge of the second glass 130 may be inserted into the glass insertion groove 152. The second glass 130 may be inserted into the glass insertion groove 152 and cover the opening 151 of the sealing member 150.

The sealing member 150 coupled to the second glass 130 may be coupled to the open surface of the case 140. The sealing member 150 may seal a space between the second glass 130 and the open surface of the case 140. In this way, hot air outside the case 140 may be prevented from being introduced into the case 140 through the open surface of the case 140. The temperature inside the case 140 may be lowered, and the temperature condition for the LED 111 disposed inside the case 140 may be satisfied.

The case 140 in which the second glass 130 and the sealing member 150 are coupled may be disposed at an upper portion of the first glass 120. In this way, the second glass 130 may be disposed at an upper portion of the first glass 120 with a predetermined space therebetween. By the first glass 120 and the second glass 130 being placed above and below each other, hot air generated from below the case 140 may be insulated in double layers. By including such a double insulation structure, the lamp module 100 of the present disclosure may satisfy the temperature condition for the LED 111.

According to another embodiment of the present disclosure, the lamp module 100 may include a single glass. In this case, the lamp module 100 may include a single tempered glass instead of the plurality of glasses. Here, the tempered glass may be etched to disperse light radiated from the LED 111. That is, according to the present embodiment, the lamp module 100 may include a single sheet of tempered glass that is etched.

The sealing member 150 may be formed of a flexible material. For example, the sealing member 150 may be formed of a rubber material. As the sealing member 150 is formed of a flexible material, the second glass 130, which is highly brittle, may be easily fitted and coupled to the glass insertion groove 152 of the sealing member 150. The sealing member 150 may be easily fitted and coupled to the case 140.

The case 140 may further include a bracket unit 143 configured to be coupled to the upper surface of the first cooking compartment 12. The bracket unit 143 may be disposed at both side surfaces (143*a* and 143*b*) of the case 140. According to the present embodiment, the bracket unit 143 may be formed by bending the both side surfaces of the case 140 in a process of forming the air suction hole 141. The bracket unit 143 may include a bracket hole 144 (144*a* and 144*b*). An engaging member (not illustrated) may be engaged to the bracket hole 144, and the case 140 may be coupled to the first cooking compartment 12.

The case 140 may further include the coupling hole 145 disposed in an upper surface thereof. The coupling hole 145 may be disposed to correspond to the engaging hole 112 disposed in the LED lamp 110. As illustrated in FIG. 8, the engaging hole 112 and the coupling hole 145 (145*a* and 145*b*) may be disposed at positions corresponding to each other. Although not illustrated in the drawings, the engaging member may be inserted into the engaging hole 112 and the coupling hole 145 to couple the LED lamp 110 to the case 140.

As is apparent from the above description, according to the idea of the present disclosure, a lamp module including a light emitting diode (LED) lamp and a cooking appliance including the same can be provided.

According to the idea of the present disclosure, a lamp module that satisfies a temperature condition for an LED to operate and a cooking appliance including the same can be provided.

According to the idea of the present disclosure, a lamp module, which uses an LED but does not cause a shadow to be formed inside a cooking compartment, and a cooking appliance including the same can be provided.

Particular embodiments have been described above and illustrated in the drawings. However, the present disclosure is not limited to the particular embodiments, and one of ordinary skill in the art to which the disclosure pertains should be able to modify and practice the present disclosure in various other ways without departing from the gist of the technical idea of the disclosure defined in the claims below.

What is claimed is:

1. A cooking appliance comprising:

a cooking compartment;

a plurality of cooling fans disposed at an upper part of the cooking compartment and configured to suction outside air into the cooking appliance and discharge the suctioned air out of the cooking appliance to thereby form a plurality of air flow paths including an airflow path formed between the plurality of cooling fans; and a lamp assembly configured to illuminate an inside of the cooking compartment, and the lamp assembly disposed on one or more of the plurality of air flow paths so that the lamp assembly exchanges heat generated by the lamp assembly with the suctioned air, wherein the lamp assembly including:

a case having:

an opening disposed at a bottom part of the case;

an air suction hole disposed at both side parts of the case, respectively, and configured to suction the outside air into the case by the plurality of cooling fans; and an air exhaust hole disposed at a rear part of the case and configured to discharge the suctioned air suctioned through the air suction hole by the plurality of cooling fans; and a light emitting diode (LED) lamp coupled to the case, configured to illuminate the inside of the cooking compartment by radiating light toward the cooking compartment, and being cooled by exchanging the heat with the suctioned air.

2. The cooking appliance of claim 1, wherein the lamp assembly further includes a plurality of glasses configured to insulate the LED lamp in multiple layers from hot air inside the cooking compartment.

3. The cooking appliance of claim 2, wherein:

the plurality of glasses include a first glass, and a second glass that is placed above the first glass; and the first glass includes an etching glass configured to disperse light radiated from the LED lamp.

4. The cooking appliance of claim 3, wherein the second glass is disposed to cover the opening of the case.

5. The cooking appliance of claim 4, wherein the lamp assembly further includes a sealing member couplable to the second glass and the case to thereby couple the second glass to the case and seal a space between the opening of the case and the second glass.

6. The cooking appliance of claim 1, wherein the LED lamp is disposed at a front of the case to prevent light radiated from the LED lamp from exiting through the air exhaust hole.

7. The cooking appliance of claim 1, wherein the case further includes at least one bracket so that the case is couplable to an upper surface of the cooking compartment.

8. The cooking appliance of claim 1, wherein the plurality of cooling fans respectively includes:

a suction hole disposed at both side surfaces of the cooling fan to suction the air; and a discharge hole disposed at a rear surface of the cooling fan to discharge the suctioned air.

9. The cooking appliance of claim 8, wherein the lamp assembly is disposed in front of the plurality of cooling fans so that the outside air suctioned by the plurality of cooling fans to pass through the lamp assembly and then be suctioned into the discharge holes of the plurality of cooling fans.

10. The cooking appliance of claim 1, further comprising a heater disposed at an upper surface of the cooking compartment to heat an object to be cooked inside the cooking compartment.

11. The cooking appliance of claim 10, wherein the lamp assembly is above and in front of the heater to reduce hot air being transferred to the lamp assembly.

12. The cooking appliance of claim 1, wherein the cooking compartment includes a first cooking compartment and a second cooking compartment that is placed above the first cooking compartment.

13. A cooking appliance comprising:

a cooking compartment;

a heater disposed inside the cooking compartment to heat an object to be cooked; and a lamp assembly including:

a case having:

an opening disposed at a bottom part thereof;

an air suction hole disposed at both side parts of the case, respectively, and configured to suction outside air into the case; and an air exhaust hole disposed at a rear part of the case and configured to discharge the suctioned air suctioned through the air suction hole;

a light emitting diode (LED) lamp coupled to the case, configured to illuminate an inside of the cooking compartment by radiating light toward the opening of the case, and the LED lamp being cooled by exchanging heat with the suctioned air; and a plurality of glasses configured to insulate the LED lamp in multiple layers from hot air inside the cooking compartment, wherein the LED lamp includes one or more engaging holes and the case further includes a LED lamp insertion opening disposed at a side part of the case so that the LED lamp is inserted into the LED lamp insertion opening to align the one or more engaging holes with the one or more coupling holes to couple the LED lamp to the case.

14. The cooking appliance of claim 13, wherein:

the plurality of glasses include a first glass and a second glass that is placed above the first glass; and the first glass includes an etching glass configured to disperse light radiated from the LED lamp.

15. The cooking appliance of claim 13, wherein the case is configured to accommodate the LED lamp therein.

16. The cooking appliance of claim 15, wherein the LED lamp is disposed at a front of the case to prevent light radiated from the LED lamp from exiting through the air exhaust hole.

17. A lamp assembly comprising:

a case having an opening disposed at a bottom part thereof, an air suction hole disposed at both side parts of the case, respectively, one or more coupling holes, and configured to suction outside air into the case, and an air exhaust hole disposed at a rear part of the case and configured to discharge the air suctioned through the air suction hole;

a light emitting diode (LED) lamp coupled to the case, configured to radiate light toward the opening of the case, the LED lamp being cooled by exchanging heat with the suctioned air; and a plurality of glasses configured to cover the opening and insulate the LED lamp in multiple layers, wherein the LED lamp includes one or more engaging holes and the case further includes a LED lamp insertion opening disposed at one of the side part of the case so that the LED lamp is inserted into the LED lamp insertion opening to align the one or more engaging holes with the one or more coupling holes to couple the LED lamp to the case.

18. The cooking appliance of claim 1, wherein the LED lamp includes one or more engaging holes and the case further includes a LED lamp insertion opening disposed at one of the side part of the case so that the LED lamp is inserted into the LED lamp insertion opening to align the one or more engaging holes with the one or more coupling holes to couple the LED lamp to the case.

* * * * *